United States Patent [19]

Sato

[11] 4,149,460

[45] Apr. 17, 1979

[54] PRINTING DEVICE FOR HAND LABELER

[75] Inventor: Yo Sato, Tokyo, Japan

[73] Assignee: Kabushiki Kaisha Sato Kenkyusho, Tokyo, Japan

[21] Appl. No.: 783,394

[22] Filed: Mar. 31, 1977

[30] Foreign Application Priority Data

Apr. 10, 1976 [JP] Japan ..... 51-39823

[51] Int. Cl.[2] ..... B41K 1/12

[52] U.S. Cl. ..... 101/110; 101/288

[58] Field of Search ..... 101/110, 287, 288, 111

[56] References Cited

U.S. PATENT DOCUMENTS

| | | | |
|---|---|---|---|
| 42,235 | 4/1864 | Spencer | 101/110 |
| 1,514,109 | 11/1924 | Stenstrom | 101/110 |
| 3,482,512 | 12/1969 | Jung | 101/110 |
| 3,796,152 | 3/1974 | Finke et al. | 101/111 |
| 3,880,078 | 4/1975 | Pelet | 101/288 |
| 3,924,532 | 12/1975 | Hubbard et al. | 101/228 |
| 3,927,613 | 12/1975 | Nantz | 101/110 |
| 3,946,665 | 3/1976 | Valentine et al. | 101/110 |
| 3,968,745 | 7/1976 | Hamisch, Jr. | 101/111 |
| 3,972,281 | 8/1976 | Sams | 101/111 |
| 4,018,157 | 4/1977 | Sato | 101/110 |
| 4,041,863 | 8/1977 | Mullen et al. | 101/110 |

*Primary Examiner*—William Pieprz

*Attorney, Agent, or Firm*—Ostrolenk, Faber, Gerb & Soffen

[57] ABSTRACT

A printing device for use with a hand labeler including a pair of juxtaposed frames spaced from each other and fixed to the body of the hand labeler; between these frames, there are juxtaposed rotatably to one another a plurality of rings which carry bar code types on their printing surfaces; a bar code ring selecting mechanism having a selecting shaft which is made rotatable and axially movable for selectively turning one of the bar code rings to bring the desired one of the bar code types into its printing position; thrusting means interposed between one of the frames and the bar code rings and is made movable between a first position for thrusting the bar code rings to the other frame so as to effect frictional contact of the bar code rings and a second position for releasing the bar code rings in order to allow their independent rotation; actuating means which are coactive with the moving means for turning the thrusting means independently of the ring selecting mechanism to effect movement thereof.

11 Claims, 15 Drawing Figures

PRINTING DEVICE FOR HAND LABELER

BACKGROUND OF THE INVENTION

1. Field of the Invention

The present invention relates generally to a label printing and applying machine of a portable type (referred to hereinafter as a "hand labeler"), and more particularly to a printing device for use with the hand labeler, which device can print both machine readable bar codes to be read out by an optical reader and human readable characters to be used for price display and read by the consumer.

2. Description of the Prior Art

As is well known in the relevant art, a continuous strip of labels is wound on a cylindrical core in the form of a roll and unwound therefrom for use. The label strip is comprised of a label tape of a self-adhesive type having its back coated with a pressure sensitive adhesive and of a tape of backing paper adhered in a longitudinal direction to the label tape so as to be peeled therefrom. The label tape is formed at a predetermined pitch with cuts to provide independent labels when it is peeled or dispensed.

In the printing device for use with the hand labeler, on the other hand, a plurality of bar code rings are arranged in parallel with one another. It is, therefore necessary that the bar code rings be in contact with each other without any clearance in between, since the bar codes are comprised of dark bars of predetermined width and of corresponding light spaces. This can be easily understood from consideration of a case in which the bar codes printed with the existence of the spare clearances may possibly be read out as different codes when subjected to the scanning operations of an optical reader. Such difficulty has already been eliminated by several proposals including that of the applicant. In one of these proposals, there is provided means for thrusting a plurality of rotatably juxtaposed bar code rings into contact for printing purposes so as to obtain the desired bar codes. This thrusting means is a unitary member which is made integral with selecting means for turning the bar code rings to select the desired bar codes.

Therefore, although the purpose for printing the desired bar codes can be attained, the operator is liable to make mistakes because both the operation for thrusting and releasing the bar code rings and the operation for turning them to select the desired bar codes are accomplished by the single unitary member. The utilization of a single operating member for two functions can sometimes lead to the performance of the undesired function.

Moreover, most of the commodities which are sold in a supermarket on a large scale are printed with the bar codes on the surfaces of their boxes or bags so as to effect source marking to inidicate the name of a manufacturer. These bar codes are under the auspices of the Association of U.S. Supermarkets and are called "UPC" symbol marks. The bar codes used in the source marking display are made to display only the registered number of the manufacturer and the code number of the food classification. It is customary that the price is not displayed on the food but is recorded in a computer. When the price is determined or changes, it may be processed into the computer through the POS terminal when the bar codes are read out by the scanning operation of the optical reader. This is called a POS (Point-of-Sale) system, which aims at dispensing with the labels themselves and their respective price display operations. More specifically, the price card on a shelf is used in place of the conventional price display on each label. The price is recorded in a computer to eliminate the need for price display on the label, thereby reducing printing costs.

After wide use in the U.S.A., however, the combined system using the source marking and the shelf card has failed to satisfy consumers. This arises from the fact that the consumer cannot check the price of a product after purchasing it because the bar codes are symbols that can be understood only by the optical reader. Thus, a number of regulations were issued concerning the local assigned codes required for price display. As a result, the human readable price display is required as an in-store marking system for each product, together with the source marking bar codes.

It is also the present practice in Japan that both the bar codes and the human readable characters are required by the consumers to be displayed on a label for practicing the POS system as in the U.S.A. In view of this practice, there has been proposed recently an in-store marking hand labeler, in which the bar codes and the human readable characters are juxtaposed widthwise on the body thereof so as to be printed on a label. The label thus used is of such width as to leave a wide spare space in the areas above and below the human readable characters. Therefore, the label becomes expensive and is not suitable for a product of small size. By the use of the wide labels, the width of the printing device is enlarged in the hand labeler so that the hand labeler becomes large, heavy and bulky as a whole and difficult to handle.

SUMMARY OF THE INVENTION

It is, therefore, an object of the present invention to provide a printing device for use with a hand labeler which is free from any of the drawbacks in the prior art.

Another object of the present invention is to provide an improved printing device, in which a thrusting lever for the thrusting means is made so independent of a turning knob for selecting the desired bar codes as to provide a printing device which is easy to handle and free from mistakes in operation.

A further object of the present invention is to provide an improved printing device of the above type, in which a selecting shaft for selecting the desired bar code rings is axially locked in response to the thrusting means for thrusting the bar code rings into frictional contact with one another for printing purposes so as to provide a more reliable printing device which is easy to handle.

A further object of the present invention is to provide an improved printing device of the above type, in which the row of the human readable letter types is arranged in parallel with the bar code types to be printed on a label longitudinally or in the direction of advancement of the label strip.

A further object of the present invention is to provide an improved printing device of the above type, the width of which can be reduced, resulting in reduction in the bulk of the entire hand labeler to enable economical use of labels and reliable and feasible handling of the hand labeler.

According to a major aspect of the present invention, a printing device is provided for use with a hand labeler capable of accomplishing a plurality of operational cycles, each having the steps of printing, dispensing and applying a label from a continuous label strip to a product, which device includes a pair of juxtaposed frames spaced from each other and fixed to the body of the hand labeler, a plurality of bar code rings juxtaposed rotatably to one another between the frames and carrying bar code types on their outer peripheries, a bar code ring selecting mechanism having a selecting shaft made rotatable and axially movable for selectively turning one of the bar code rings to bring the desired one of the bar code types into its printing position, thrusting means interposed between one of the frames and the bar code rings and movable between a first position for thrusting the bar code rings to the other of the frames so as to effect frictional contact of the bar code rings and a second position for releasing the bar code rings so as to allow their independent rotation, moving means for moving the thrusting means, and actuating means coactive with the moving means for turning the thrusting means independently of the ring selecting mechanism so as to effect movement thereof.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENT

Figure 4:
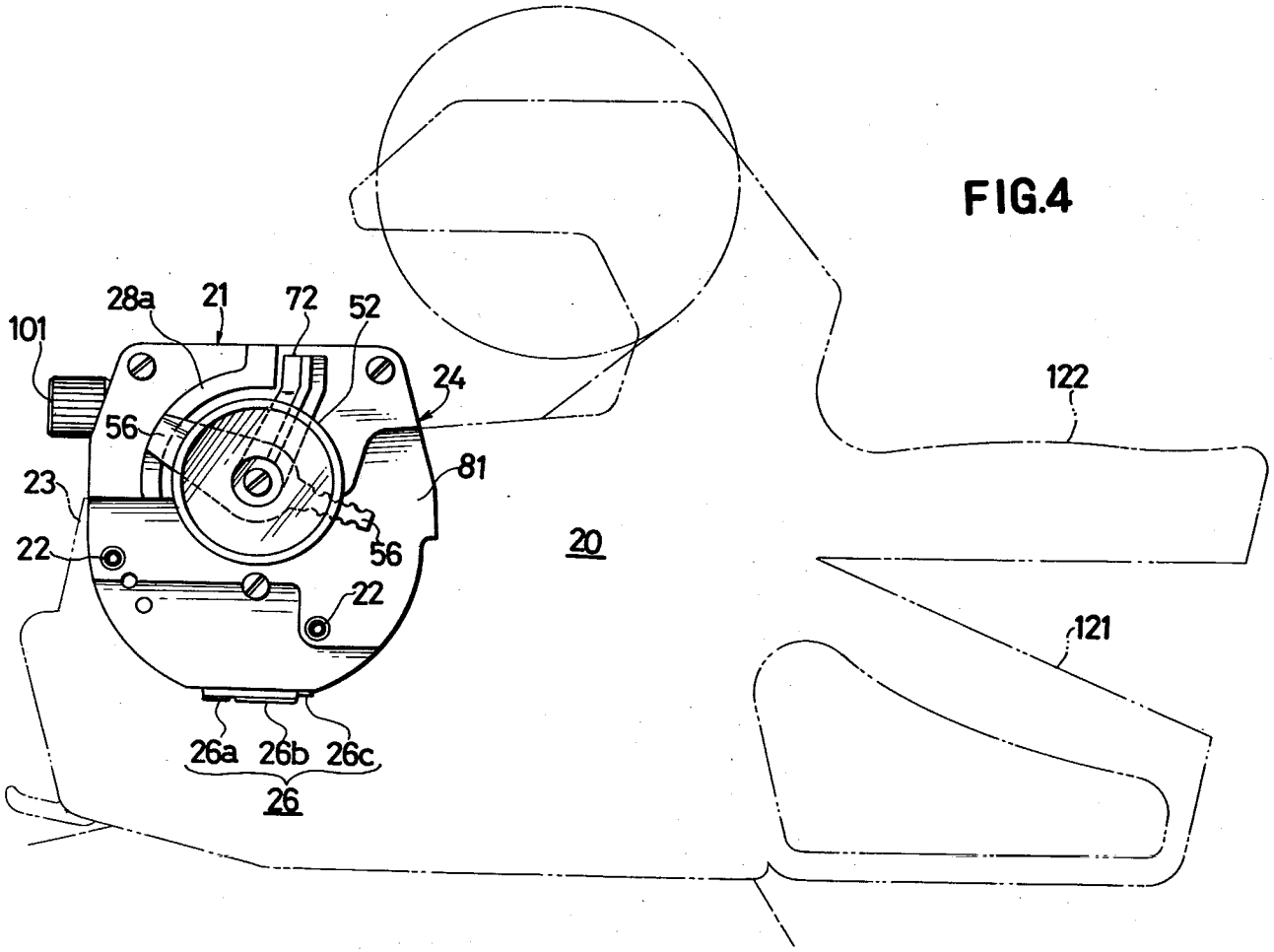
FIG. 4 is a simplified side elevation showing a hand labeler, to which the printing device according to the invention is attached.
Figure 7:
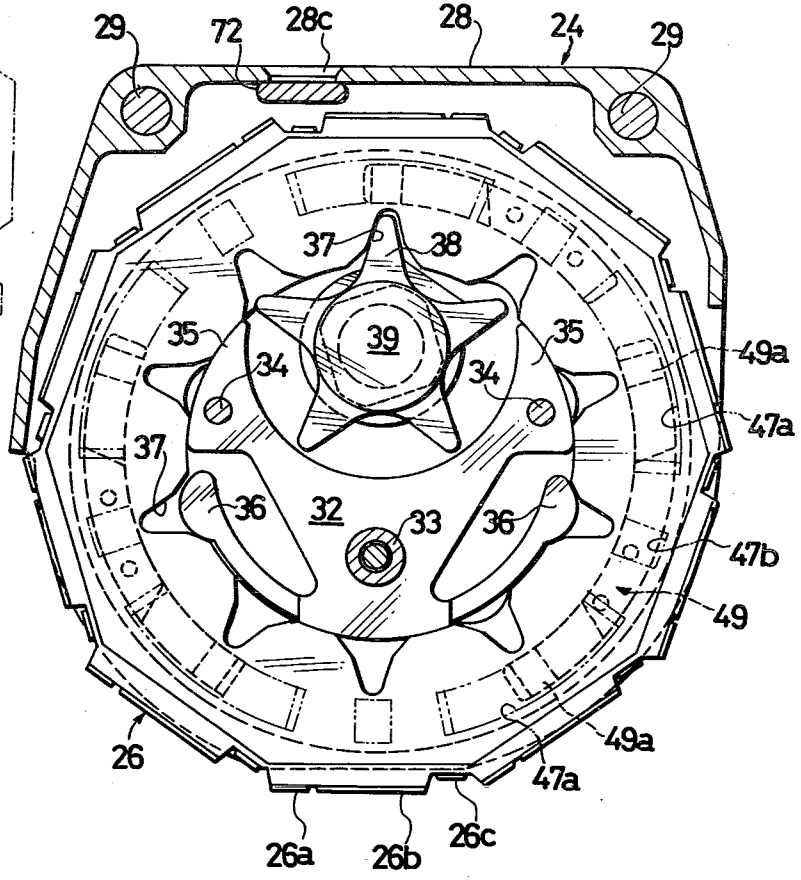
FIG. 7 is a cross-section taken along the line 7-7 of FIG. 6.

Referring first to FIG. 4, there is shown a portable label printing and applying machine for a hand labeler 20. A printing head 21 to be used with the hand labeler 20 is secured by means of screws 22 to a pair of machine frames 23 which are juxtaposed to each other at an upper front portion of the body of the hand labeler 20. The printing head 21 is, as better seen from FIG. 5, equipped with a machine readable coding mechanism 24, which is arranged in the transverse direction of the hand labeler 20, and with a human readable coding mechanism 25 which is arranged in the longitudinal direction of the hand labeler 20, namely, in the direction in which a strip of labels (not shown) is advanced.

Figure 6:
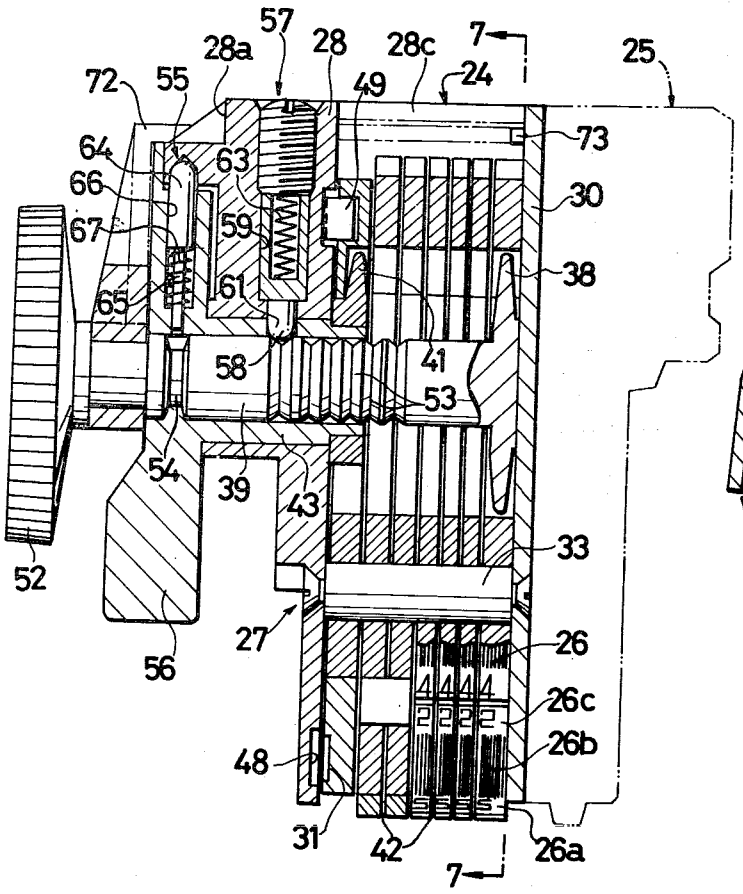
FIG. 6 is a longitudinal section of the printing device and shows the selecting operations of both the desired row of the machine readable bar code rings and the desired one of the bar code types.
Figure 9:
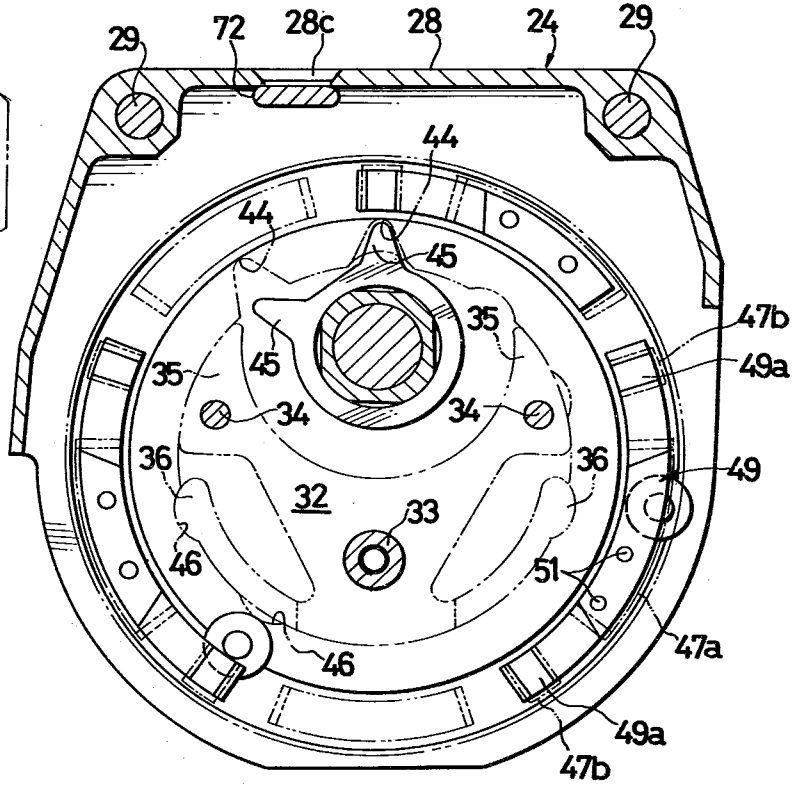
FIG. 9 is a cross-section taken along the line 9-9 of FIG. 8.
Figure 8:
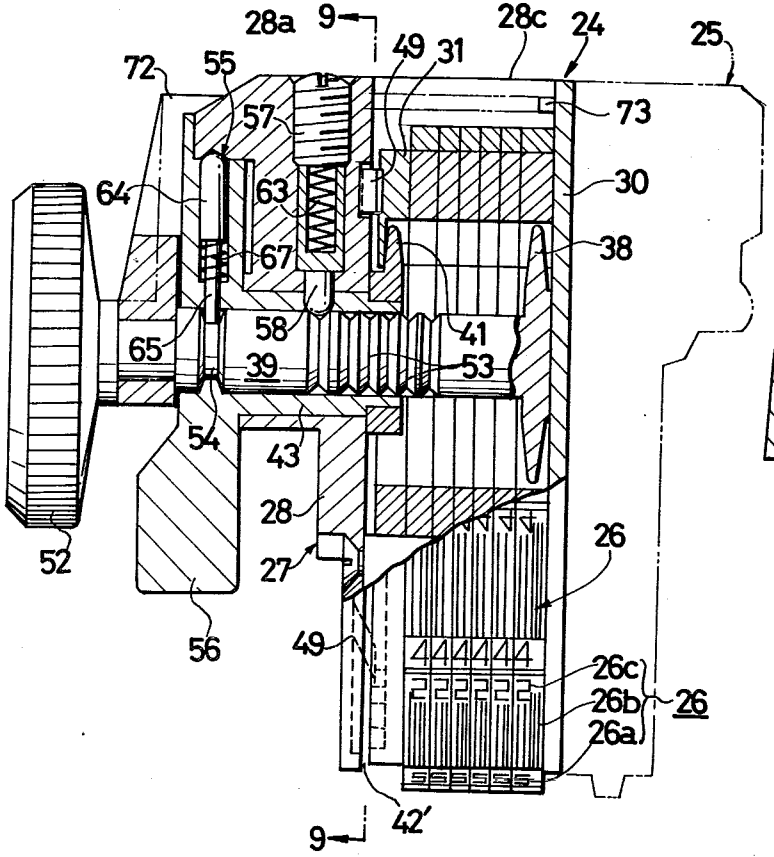
FIG. 8 is a view similar to that of FIG. 6 but shows the operations in which the machine readable bar code rings of the printing device are brought into frictional contact with one another for the printing purpose.

Turning now to FIGS. 6 to 12, the machine readable coding mechanism 24 is comprised of a plurality of bar code rings 26 which may have a regular decagonal shape and which are received in a casing 27. This casing 27 is formed of frames 28 and 30 supported on a pair of support shafts 29. Each of the type letter rings 26 is formed on its outer periphery with ten numerals 26*a* of from "0" to "9", and with bar code types 26*b* and index types 26*c*, both of which correspond to the numeral types 26*a*, respectively. These bar code rings 26 as well as pressure end plate 31, which is positioned at the left-hand side of FIGS. 6 and 8, are held in position by a positioning member 32 which in turn is supported by pivot shafts 33 and 34.

Figure 12:
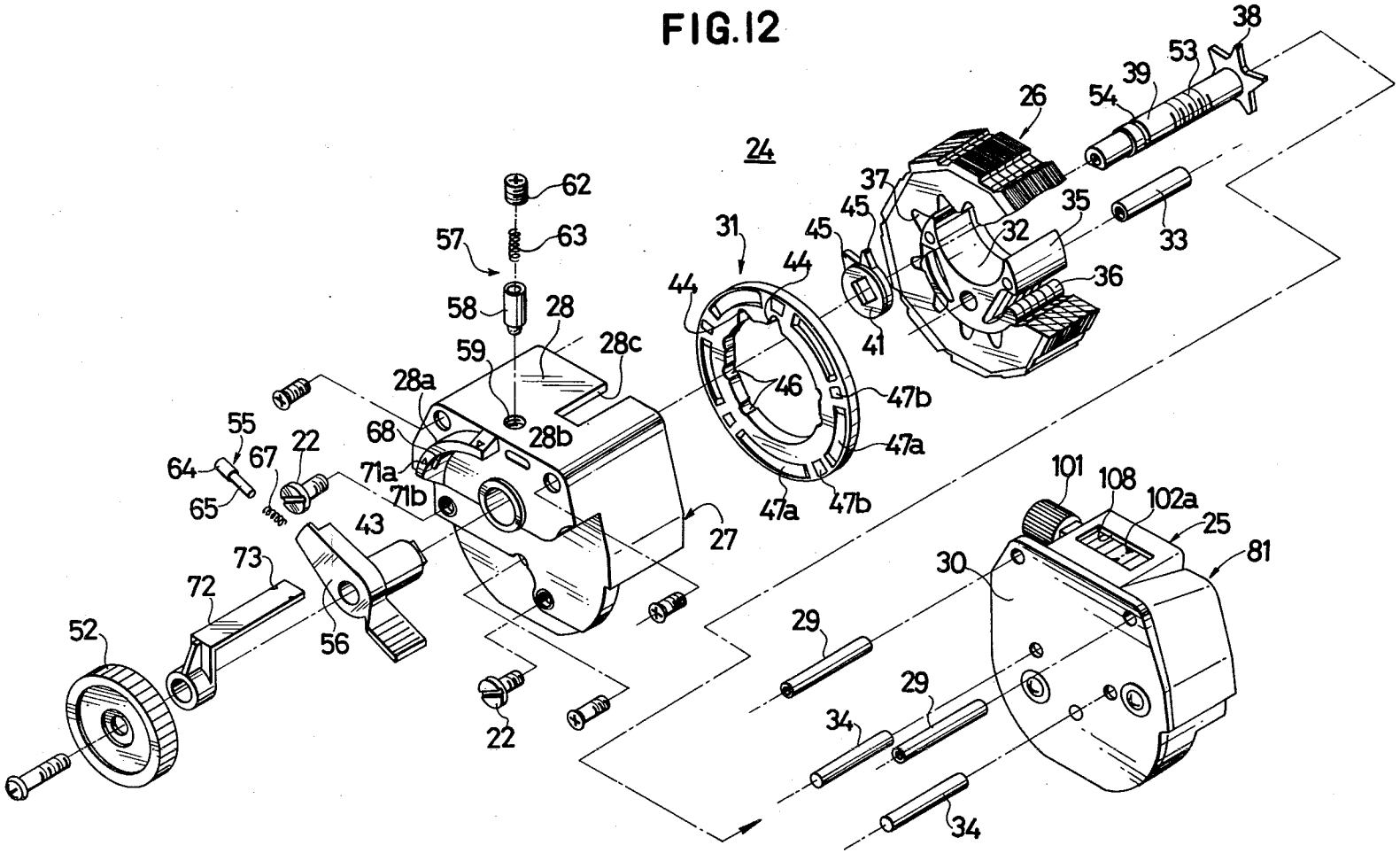
FIG. 12 is an exploded perspective view showing not only the machine readable coding mechanism but also the human readable coding mechanism of the printing device of the invention.

As better seen from FIG. 12, the positioning member 32 is formed into an integral block, and there are mounted on the outer periphery of the positioning member 32 not only a pair of thrusting members 35, which have a biasing force in the radially outward direction, but also a pair of elastic retaining members 36. The positioning member 32 is formed into such an arcuate shape that its outer periphery may be forced into contact with the inner peripheral walls of the bar code rings 26 and the end plate 31. Each of the bar code rings 26 is formed at its inner periphery with internal teeth 37 of such a number as is made to correspond to the number of the sides of the bar code 26 so that the internal teeth 37 may mesh with pinion 38 formed at the leading end of a selecting shaft 39 and so that they may retain the retaining member 36 of the positioning member 32.

Figure 10A:
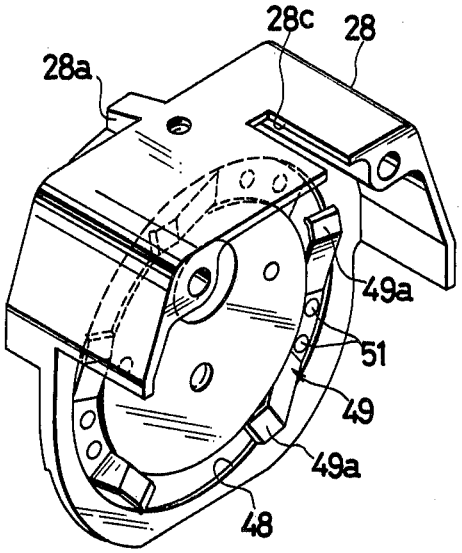
FIG. 10*a* is a perspective view showing one of the frames of the machine readable coding mechanism of the printing device of the invention.
Figure 10B:
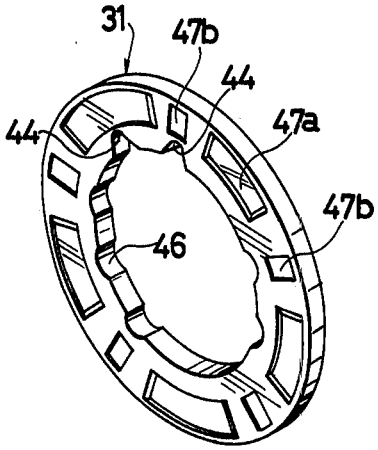
FIG. 10*b* is a perspective view showing a thrusting end plate of the machine readable coding mechanism to be used with the frame of FIG. 10*b*.

As will be easily found especially from FIG. 10*b*, the side of the end plate 31, which is arranged to face one of the frames 28, is formed with arcuate deeper and shallower recesses 47*a* and 47*b* in alternate arrangements.

Turning to FIG. 10*a*, the frame 28 is formed on one side with a peripheral groove 48, in which leaf springs 49 are retained by means of rivets 51. Each of these leaf springs 49 is made to have its free extending ends 49*a* removably fitted in the deeper and shallower recesses 47*a* and 47*b* of the end plate 31. Thus, the clearance 42 can be formed between the sides of the bar code rings 26 so as to allow selection of the desired bar code types 26*b*. Likewise, the clearance 42 can be eliminated so as to bring the sides of the bar code rings 26 into contact, thereby to bring the bar code types 26*b* into position for printing.

In short, provision is made for end plate thrusting means to drive the end plate 31 against the bar code rings 26 so as to bring the rings 26 into close contact with one another. The thrusting means can release the thrusting force to establish the clearance 42 between the sides of the rings 26. This means is comprised of cam means, which is formed with the deeper and shallower recesses 47*a* and 47*b* on the side of the end plate 31, and of the leaf springs 49 which are riveted to the frame 28.

For providing the motion of end plate 31 needed for the desired thrusting motion thereof, there is a cylindrical shaft 43 that is coaxial with and external to the selecting shaft 39 and that is rotatable with respect to shaft 39. The right hand end of shaft 43 in FIGS. 6 and 12 is profiled to extend into and matingly engage a a correspondingly profiled opening in claw wheel 41, whereby rotation of shaft 43 correspondingly rotates claw wheel 41. The claw teeth 45 on the claw wheel 41 engage in the grooves 44 in end plate 31 and rotate that plate correspondingly. This rotation moves the end plate 31 between its two possible thrust positions.

A thrusting lever 56 is integrally attached to the shaft 43 and manual actuation of lever 56 rotates shaft 43 which rotates end plate 31.

As better seen from FIGS. 6 and 8, a turning knob 52 is secured at the outside of the casing 27 to the end of the selecting shaft 39 which is operative to select the bar code rings 26 of the desired row or rows and further the desired bar code types 26*b*. The selecting shaft 39 is formed at its portion with row regulating grooves 53, which are made to correspond to the number of the bar code rings 26, and with a retaining groove 54 which is made to engage with the retaining member 55 of a thrustng lever 56.

A regulating member 57 is provided to engage with the row regulating grooves 53 of the selecting shaft 39. The regulating member 57 is arranged in a direction perpendicular to the selecting shaft 39 and is supported elastically to regulate the axial movement of the selecting shaft 39 to determine the position, in which the desired bar code ring 26 is brought into meshing engagement with the pinion 39. The regulating member thus arranged and supported is comprised of a regulating element 58, which is fitted in guide bores 59 and 61 respectively formed in the frame 28 and the cylindrical shaft 43, of a stop screw 62 and a spring 63 which is interposed between the element 58 and the stop screw 62 to hold the element 58 in pressure contact with the row regulating grooves 53.

Figure 11:
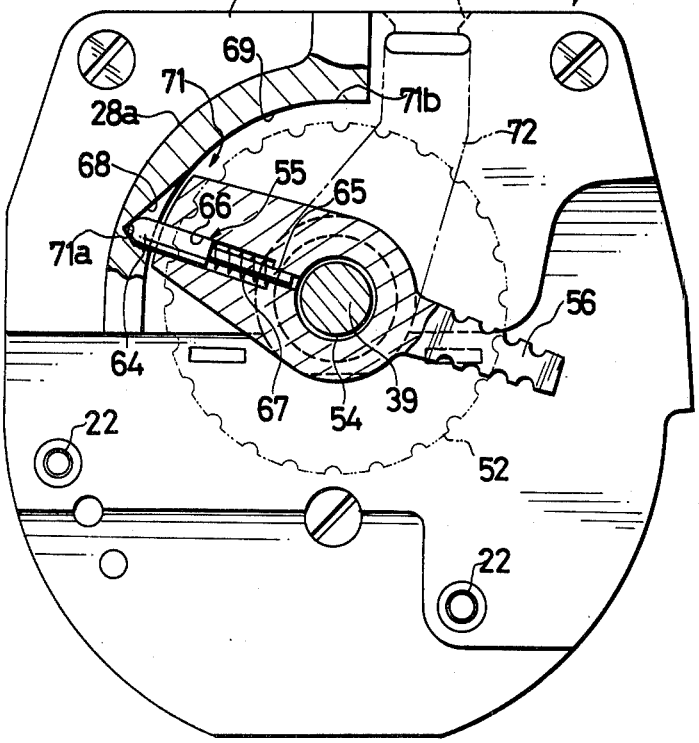
FIG. 11 is a partially cut away front elevation of the machine readable coding mechanism.

As best seen in FIG. 11, the retaining member 55, which is elastically supported in the cylindrical shaft 43, namely, in its thrusting lever 56, is removably fitted in the retaining groove 54 of the selecting shaft 39. More specifically, the retaining member 55 is comprised of a guide portion 64 and a control portion 65 and is fitted in a guide bore 66 of the thrusting lever 56 which is made integral with the cylindrical shaft 43. A spring 67 is interposed between the guide portion 64 and the guide bore 66 so as to support the retaining member 55 elastically. The retaining member 55 has its control portion 65 removably engaged with the retaining groove 54 of the selectng shaft 39 and its guide portion 64 biased by the action of the spring 67 into sliding contact with a guide groove 68 and a flat guide surface 69, both of which are formed on the inner periphery of a projecting portion 28a of the frame 28.

Thus, the means for locking the selecting shaft 39 in the axial direction during the printing operation is comprised of a cam mechanism and the retaining groove 54 formed on the selecting shaft 39. This cam mechanism includes a cam surface 71, which is comprised of the guide groove 68 and the guide surface 69, and the retaining member 55 which is biased into contact with the cam surface 71.

When the guide portion 64 of the retaining member 55 is set in the rotationally selecting position 71*a*, the clearances 42 are formed between the bar code rings 26 so as to allow the bar code rings 26 to be turned in the condition of FIG. 6, in which the desired bar code types 26*b* can be selected. Under this condition, it is assumed that the end plate 31 takes its second position. Alternatively when, the guide portion 64 is set in the printing contact position 71*b*, the clearances 42 of the bar code rings 26 are eliminated to establish the condition of FIG. 8, in which the printing operation can be carried out. Under this condition, the end plate 31 is assumed to be in its first position. In this instance, a single clearance 42' of large volume is formed between the side of the frame 28 and the open side of the bulk of the contacting bar code rings 26.

As better seen from FIGS. 6 and 12, an L-shaped indicating member 72, which is made of a transparent material, is provided in the vicinity of the turning knob 52 of the selecting shaft 39. This indicating member 72 is formed to have its leading end extending into the inside of the frame 28 through a slit 28*b* which is formed in the frame 28. At the extending end portion of the indicating member 72, there is formed an arrow mark 73 which is to be positioned above the juxtaposed bar code rings 26 so as to indicate the index type 26*c*. The frame 28 is formed at its portion with an index aperture 28*c* so as to make it possible to confirm the selecting condition of the bar code rings 26.

Discussion will now be made on the selecting operation of the bar code rings 26 of the machine readable coding mechanism 24. By the action of an actuating assembly comprised of the claw wheel 41, the cylindrical shaft 43 and the thrusting lever 56, the shift is effected from the printing condition of FIG. 8, in which the clearances 42 between the bar code rings 26 are eliminated to bring the rings 26 into contact with one another with the resultant formation of the single larger clearance 42', to the selecting condition of FIG. 6, in which the plural clearances 42 are formed between the rings 26.

More specifically, the thrusting lever 56 outside of the casing 27 is turned counterclockwise into the condition of FIG. 11. Then, the guide portion 64 of the retaining meber 55 is shifted from the printing position 71*b* to the selecting position 71*a*, namely, into the guide groove 68. Since, in this instance, the guide portion 64 is biased in the direction toward its leading end by the action of the spring 67, the control portion 65 of the retaining member 55 is removed from the retaining groove 54 of the selecting shaft 39. As a result, the selecting shaft 39 is set free to move in the axial direction, and at the same time the end plate 31 is turned coactively in the counterclockwise direction by the claw wheel 41 which is mounted on the cylindrical shaft 43 made integral with the thrusting lever 56.

In the meantime, the free ends 49*a* of the leaf springs 49, which have been trapped in the shallower recesses 47*b* of the end plate 31, are allowed to escape therefrom and are brought into engagement with the deeper recesses 47*a*. As the biasing forces of the leaf springs 49 are weakened as the result of the engagement, the sides of the bar code rings 26 are released from the contacting conditions which have been kept by the biasing force of the leaf springs 49. At the same time, the clearances are established between the bar code rings 26 to permit selection of the desired one of the bar code types of the rings 26 by the manually turning operations. Meanwhile, the single clearance 42' during the contacting condition is reduced materially.

Since the selecting shaft 39 has already been released to slide in the axial direction as above, the desired bar code types 26b can be brought into their printing positions by shifting the pinion 38 of the selecting shaft 39 to the position of the bar code rings 26 of a particular row to enable selection, by bringing the pinion 38 into meshing engagement with the internal teeth 37 of that particular ring 26, and then by turning the knob 52 by a suitable angle. Thus, the desired bar code types 26b can be selected while observing through the index aperture 28c the index types 26c of the bar code ring 26 which is pointed out by the arrow mark 73 on the indicating member 72 made coactive with the selecting shaft 39. This occurs because the arrow mark 73 is made to correspond to the setting position of the pinion 38 of the selecting shaft 39.

During the time period while the desired bar code types 26b are being selected by turning the knob 52, the regulating element 58 of the regulating member 57 is forced into the row regulating groove 53 of the selecting shaft 39 by the biasing force of the spring 63, thus prohibiting the axial movement of the selecting shaft 39. As a result, the pinion 38 will never be allowed to slide axially to the bar code ring 26 of another row.

Turning now to the operation in which the bar code rings 26 of the machine readable coding mechanism 24 are thrust into contact with one another, after the selections have been made of the desired bar code types 26b of the bar code rings 26 of the desired rows, the knob 52 of the selecting shaft 39 is forced into the inside of the casing 27, namely, in the rightward direction in FIG. 6. After that, the thrusting lever 56 is turned in the clockwise direction from the selecting position 71a to the printing position 71b, as seen in FIG. 11. Then, the guide portion 64 of the retaining member 55 is forced radially inwardly by the action of the guide surface 69 against the biasing force of the spring 67 so that the inward control portion 65 may be brought into engagement with the retaining groove 54 of the selecting shaft 39. Thus, this selecting shaft 38 is prohibited from sliding movement in the axial direction.

In accordance with the rotation of the thrusting lever 56, the free ends 49a of the leaf springs 49, which have been trapped in the deeper recesses 47a of the end plate 31, are released therefrom into engagement with the shallower recesses 47b by the action of the claw wheel 41. Thus, the increased thrusting force of the leaf springs 49 will eliminate the clearances 42 which have been formed between the bar code rings 26, thereby bringing the sides of the rings 26 into close contact with one another. Meanwhile, the other single clearance 42' is formed. Under this contact condition, the friction between the bar code rings 26 will prevent free rotation, resulting in a stable printing operation.

Figure 5:
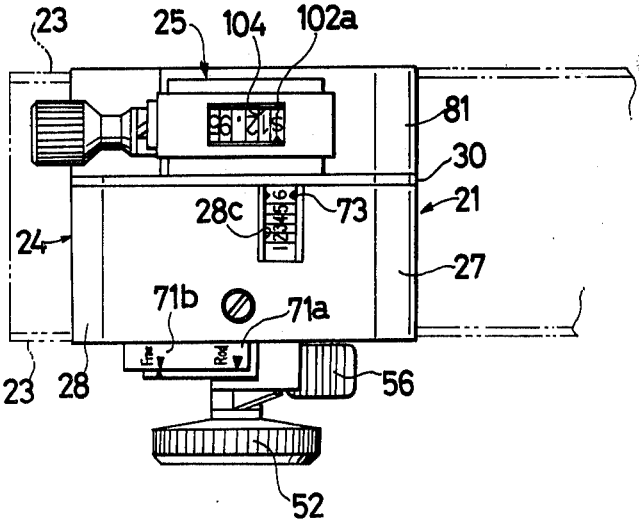
FIG. 5 is a top plan view showing the arrangement of the printing device of the present invention.
Figure 14:
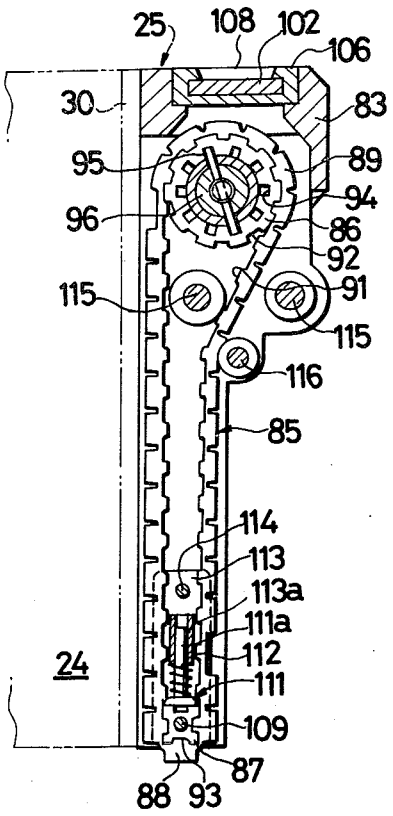
FIG. 14 is a cross-section taken along the line 14-14 of FIG. 13.
Figure 13:
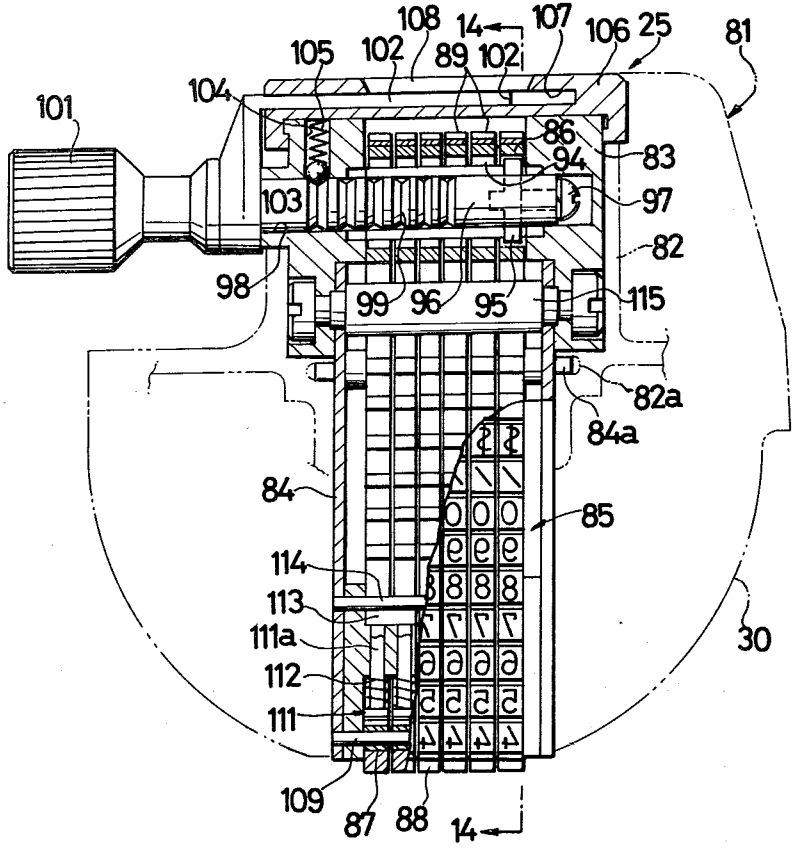
FIG. 13 is a longitudinal section of the human readable coding mechanism.

Turning now to FIGS. 13 and 14 as well as FIGS. 5 and 12, the human readable coding machine 25 is supported in a casing 81 which is comprised of a frame 82 in addition to the frame 30 acting as the partition between the human readable coding machine 26 and the machine readable coding machine 24. The casing 81 is attached to one side of the paired machine frames 23 by means of screws.

A cylindrical support 83 and a frame 84 are attached to the frame 82 by means of screws such that the attachment members 84a projecting from both sides of the frame 84 are fitted in the attachment bores 82a in the frame 82.

In the casing 81 of the cylindrical support 83 and of the frame 84, there are juxtaposed a plurality of endless type bands 85, each of which is arranged to run on a selecting ring 86 and a positioning insert 87. Each of the endless type bands 85 is formed on its outer periphery with a plurality of types 88, which are made to project therefrom to indicate the price of a product in the form of numerals or letters, and on its remaining side with index letters 89 which correspond to the types 88. Each of the type bands 85 is also formed on its inner periphery with engagement portions 91 at a pitch to correspond to the types 88. These engagement portions 91 are made engageable with recesses 92 and 93, which are formed in the outer peripheries of the selecting rings 86 and the positioning inserts 87, respectively, so as to effect rotational transfers of the endless type bands 85.

In the inner peripheries of the selecting rings 86, there are formed inner peripheral recesses 94, in which is fitted an engagement member 95 which is secured to a selecting shaft 96 by means of a stop screw 97. The selecting shaft 96 is fitted loosely in a sliding bore 98 which is formed in the cylindrical support 83. Moreover, this selecting shaft 96 is formed with annular row regulating grooves 99 which are arranged to correspond to the endless type bands 85. At one end of the selecting shaft 96, are a turning knob 101 and an indicating member 102 which is formed with an L-shaped arrow mark 102a. A steel ball 103 is received in a setting bore 104, which is formed in the cylindrical support 83 and is biased by a spring 105 against the walls of the row regulating grooves 99, thereby to ensure the selection of the endless type bands 85 of the desired rows. The upper portion of the cylindrical support 83 is covered with a cover member 106, which is formed with a sliding groove 107, to permit the indicating member 102 to slide, and with an index aperture 108.

The positioning inserts 87, which are operative to hold the types 88 of the endless type bands 85 in position, are made rotatable on a shaft 109 which is supported in the frame 84. Each of the positioning inserts 87 has its inner side supported elastically by a pressure member 111 so that the insert 87 may be prevented from free rotation and the types 88 on the endless type bands 85 may be held in flat position at all times. More specifically, the pressure member 111 has a guide rod on which a spring 112 is mounted at its one end. The other end of this spring 112 is arranged to abut against the cylindrical portion 113a of a support member 113, which is mounted on a support shaft 114, so that the pressure member 111 may be elastically biased at all times in the direction toward the corresponding one of the positioning inserts 87.

Indicated at reference numeral 115 are attachment members which are used to attach the frame 84 to the cylindrical support 83. Indicated at numeral 116 is a roller which is operative to prevent slackness of the type bands 85.

The selection of the types of the human readable coding mechanism 25 will now be described. These selection operations are carried out so that the price of a product, the coding number of which is displayed on a label in the form of bar codes together with its manufacturer's number, may be displayed on the label by the use of the endles type bands 85 in addition to the bar codes. In this instance, the knob 79 is pulled leftwardly of FIG. 13 until the arrow mark 102 of the indicating member 104 reaches the position of the endless type band 85 of the row having the numeral which the operator desires to select. Then the knob 101 is turned so that the desired type 88 may be brought into the printing position where it can be printed on the label. In this setting operation, since the engagement member 95 of the selecting shaft 96 is in engagement with the inner peripheral recess 94 of the corresponding selecting ring 86, the selecting ring 86 can be turned together with the corresponding type band 85. During selecting operation of the desired types, the endless type band 85 of the desired row can be reliably selected in the axial direction because the steel ball 103 is elastically urged in the corresponding row regulating groove 99 of the selecting shaft 96. In the rotational direction, moreover, the types 88 can also be reliably positioned one by one on the printing surface of the corresponding type band 85 because the corresponding positioning insert 87 is elastically supported.

After the selecting operation of the endless type bands 85, the knob 101 is returned to its original position of FIG. 13 by forcing it into its right-hand position.

Figure 1:
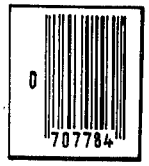
FIG.1 PRIOR ART
FIG. 1 is a top plan view showing a label printed with bar codes by a conventional printing device of a hand labeler.
Figure 2:
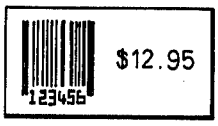
FIG.2 PRIOR ART
FIG. 2 is similar to FIG. 1 but shows a label printed with not only bar codes but also human readable characters by another conventional printing device of a hand labeler.
Figure 3:
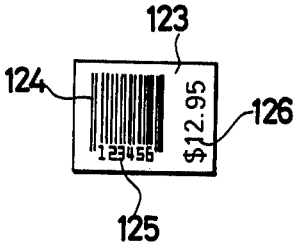
FIG. 3 is similar to FIGS. 1 and 2 but shows a label printed with bar codes and human readable characters by the printing device according to the present invention.

Referring now to FIG. 4, when a hand lever 121 of the hand labeler 20 with the printing head 21 of the above construction is squeezed toward a grip 122, a label 123 placed on a printing platen (not shown) is imprinted with the desired information, as shown in FIG. 3. The platen may be of the type made movable in response to the motion of the hand lever 121. More specifically, the label 123 is imprinted at its left-hand (seen from the advancing direction of the label strip) side with bar codes 124 and a number 125 corresponding thereto by the machine readable coding mechanism 24. The right edge portion of the label 123 is also imprinted with human readable letters 126 by the action of the human readable coding mechanism 25.

Incidentally, the number 125 is used not for the normal operations but for the manual key-in operations of a P.O.S. (Point-of-Sale) scanning system in case the bar codes 124 become optically unreadable, resulting in being rubbed out or soiled with ink.

In view of the above description, the following are the salient advantages of the present invention:

Since the respective bar code rings are brought into frictional contact for the printing operation and released for the selecting operation of their bar code types by the actions of the actuating means, no undesired clearance is established between the bar code rings during the printing operation so as to make it possible to effect the predetermined printing of the bar code types by the combination of the dark bars of a predetermined width and the corresponding light spaces.

Since the selecting shaft made operative to turn the type letter rings to effect selection of the bar codes is axially locked by the locking means under the condition in which the bar code rings are in contact for the printing operation by the actions of the actuating means, no malfunction of the selecting shaft takes place during the printing operation.

Since the printing head of the invention is made in such manner that the bar code rings are thrust into frictional contact or are released to form the clearances in between for free rotation independent of the turning knob, which is operative to turn the bar code ring of the desired row to select the desired bar code type, the printing device can be prevented from being broken by erroneous operation. This is quite different from prior art devices of this kind, in which the formation of the clearances between the bar code rings, the selection of the row of the bar code rings and of the bar code types, and the frictional contacts are all accomplished by a single turning knob with the resultant increase in erroneous operation.

Since the bar code rings can be brought into frictional contact by the combined actions of the claw wheel attached to the cylindrical shaft, the pressure end plate formed with the arcuate recesses and the frame equipped with leaf springs, printing operation of such bar codes as are read by an optical reader can be ensured.

Since the retaining member received in the guide bore of the thrusting lever has its portion biased elastically into the grooved guide surface, which is formed on the frame, so that its other portion may be forced against the biasing force into the retaining groove which is formed in the outer periphery of the selecting shaft, this selecting shaft can be prevented without fail from shifting in the axial direction by the trapping action of the retaining groove as well as by the thrusting action of the claw wheel, the end plate and the frame during the period in which the bar code rings are being thrust into frictional contact for printing purposes.

Since the machine readable coding mechanism is arranged perpendicularly of the human readable coding mechanism such that the row of the letter types is arranged in parallel with the bar code types, the printing device can be assembled in a compact manner having a small width. Thus, the hand labeler equipped with this printing device minimizes bulk and enables ease in handling.

Since there is no spare space on a label printed by the printing device having its machine and human readable coding mechanisms arranged perpendicular of each other, the paper material for the labels can be economically minimized.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. In a printing device for use with a hand labeler capable of accomplishing a plurality of operational cycles, each having the steps of printing, dispensing and applying a label from a continuous label strip to a commodity, said printing device including a pair of juxtaposed frames spaced from each other and fixed to the body of said hand labeler;

a plurality of bar coding rings juxtaposed to one another between said frames and carrying bar coding types on their outer peripheries, and a bar coding ring selecting mechanism having a selecting shaft, said selecting shaft being rotatable and axially movable for selectively turning one of said bar coding rings to bring the desired one of said bar coding types into its printing position;

the improvement comprising: thrusting means interposed between one of said frames and said bar coding rings and being rotatable about said selecting shaft; said thrusting means being rotatable between a first position for thrusting said bar coding rings to the other of said frames so as to compress them together and effect frictional contact of each of said bar coding rings with the neighboring said bar coding ring and a second position for releasing said bar coding rings from the thrust together frictional contact so as to allow their independent rotation;

moving means in engagement with said thrusting means for moving said thrusting means when said thrusting means is being rotated for alternately causing said thrusting means to move axially of said selecting shaft between said first and said second positions thereof; and actuating means for turning said thrusting means around said selecting shaft independently of motion of said ring selecting mechanism so as to effect the movements of the same.

2. In a printing device according to claim 1, wherein said bar coding rings are in a row extending along a first direction; the improvement further comprising a plurality of endless type bands carrying letter types on their respective outer peripheries and juxtaposed to one another in a second row extending along a second direction such that the said second direction of said row of the letter types in their printing positions is arranged to extend perpendicular to said first row of the juxtaposed bar coding types in their printing positions; and a type band selecting mechanism having a selecting shaft made rotatable and axially movable for selectively moving one of said type bands to bring the desired one of said letter types into its printing position; said bar coding rings carrying bar codes for displaying information about a commodity and said type bands carrying letter types for displaying information about the same commodity and said bar coding rings and said type bands both being adapted to be rotated such that said bar codes and said letter types may convey related information about the same commodity, in a bar code and in a set of letter types.

3. A printing device according to claim 1, wherein said thrusting means includes an annular plate rotatably supported coaxially with said bar coding rings and formed with retaining grooves, and wherein said actuating means includes a claw wheel having retaining claws made engageable with said retaining grooves of said annular plate such that rotation of said claw wheel rotates said annular plate between said thrusting means first and second positions.

4. A printing device according to claim 3, wherein said actuating means further includes a cylindrical shaft having its one end fixed to said claw wheel and its other end extending to the outside from the one of said frames, and an actuating lever made integral with the extending portion of said cylindrical shaft and made manually actuatable for effecting the turns of said annular plate.

5. A printing device according to claim 3, wherein said moving means includes cam means having deeper and shallower recesses formed in one side of said of said annular plate and spaced angularly from each other, and a leaf spring fixed to the one of said frames and having its leading ends received in one of said deeper and shallower recesses in response to the rotations of said annular plate.

6. A printing device according to claim 1, further comprising locking means connectable with said actuating means for locking said selecting shaft in the axial direction when said thrusting means is in its first position.

7. A printing device according to claim 6, wherein said locking means includes retaining means having a retaining annular groove formed in the outer periphery of said selecting shaft, and cam means having a cam surface formed in the inner periphery of the one of said frames and a retaining member biased elastically into engagement with said cam surface for being brought into said annular groove against the biasing force so as to effect the axial locking of said selecting shaft when it is slid on said cam surface.

8. A printing device according to claim 7, wherein said cam surface has a guide groove and a guide surface for bringing said retaining member into said annular groove.

9. A printing device according to claim 7, wherein said thrusting means includes an annular plate rotatably supported coaxially with said bar coding rings and formed with plate engaging means, and wherein said actuating means includes actuating means engaging means and said plate engaging means being in engagement with said actuating means engaging means; means for rotating said actuating means.

10. A printing device according to claim 1, wherein said thrusting means includes an annular plate rotatably supported coaxially with said bar coding rings and formed with plate engaging means, and wherein said actuating means includes actuating means engaging means and said plate engaging means being in engagement with said actuating means engaging means; means for rotating said actuating means.

11. A printing device according to claim 4, wherein said actuating means further includes a cylindrical shaft having its one end fixed to said actuating means engaging means and its other end extending to the outside from one of said frames, and an actuating lever made integral with the extending portion of said cylindrical shaft and made manually actuatable for effecting the turns of said annular plate.

* * * * *